United States Patent [19]

Barratt et al.

[11] 3,942,482

[45] Mar. 9, 1976

[54] BAYONET TUBE STEAM GENERATOR

[75] Inventors: Robert O. Barratt, Cedar Knolls; John Polcer, Florham Park; Richard James Swift, Denville, all of N.J.

[73] Assignee: Foster Wheeler Energy Corporation, Livingston, N.J.

[22] Filed: Oct. 9, 1974

[21] Appl. No.: 513,356

[52] U.S. Cl. ..... 122/32; 122/318; 122/483; 165/142

[51] Int. Cl.[2] ..... F22B 1/06; F22B 5/02

[58] Field of Search ..... 122/32, 33, 34, 318, 483; 165/142

[56] References Cited

UNITED STATES PATENTS

| | | | |
|---|---|---|---|
| 3,054,599 | 9/1962 | Fabregas | 122/318 X |
| 3,097,630 | 7/1963 | Kinyon et al. | 122/483 X |
| 3,557,760 | 1/1971 | Romanos et al. | 122/483 |
| 3,613,781 | 10/1971 | Barratt | 122/32 |
| 3,741,167 | 6/1973 | Polcer et al. | 122/483 |

*Primary Examiner*—Kenneth W. Sprague
*Attorney, Agent, or Firm*—John E. Wilson; Marvin A. Naigur

[57] ABSTRACT

Water is flowed through bayonet tubes where it is heated to steam which is superheated in other bayonet tubes all the bayonet tubes extending from a single tube sheet. Heated water enters the inner tube of a bayonet tube assembly so that it is heated in the annulus between the inner tube and its associated outer tube and then flows into the annular space between the inner and outer tube of the second bayonet tube assembly so that it is is heated to steam to leave by the inner tube of the second bayonet tube assembly to then flow into the annular space between the inner and outer tubes of the third bayonet tube assembly to be superheated and leave the third bayonet assembly by the inner tube thereof, the flow between one or more of the bayonet tube assemblies being connected by connecting tubes which connect with thermal sleeves covering the inner tubes of the bayonet tube assemblies below the single tube sheet.

5 Claims, 1 Drawing Figure

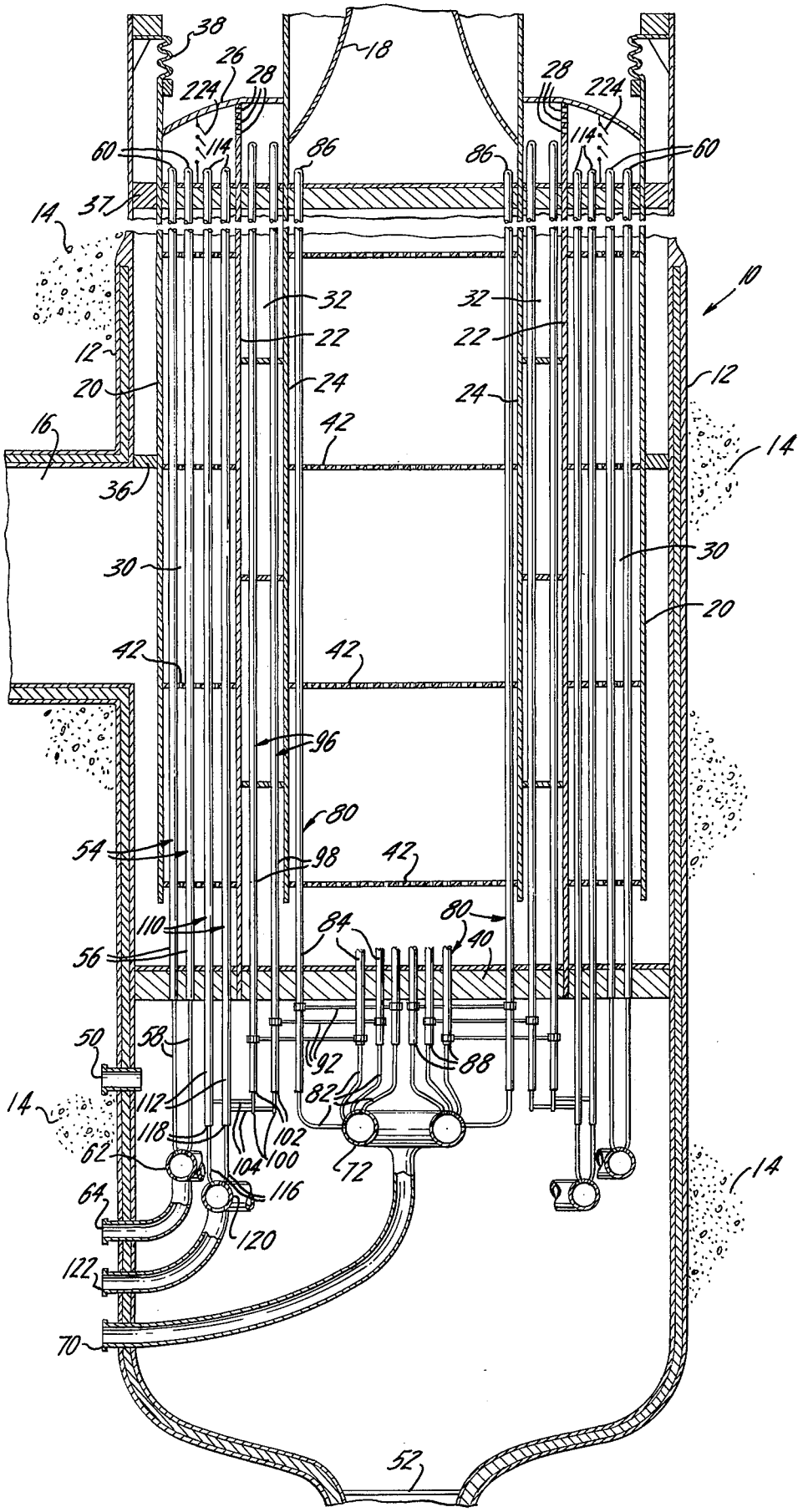
38
26
28
18
224
28
224
60
114
86
86
114
60
37
14
10
32
32
22
22
12
20
24
24
12
16
42
14
36
30
30
20
42
42
96
80
54
98
42
110
84
80
40
56
50
58
92
88
14
112
82
118
102
62
104
100
72
14
64
116
120
122
70
52

BAYONET TUBE STEAM GENERATOR

BACKGROUND OF THE INVENTION

Most, if not all, nuclear power plants use the heat which is generated in the nuclear reactor to generate steam which is used to provide mechanical energy. The heating medium such as liquid sodium or hot gas which is heated by the heat energy generated in the nuclear reactor is flowed through a steam generator in which water to be heated and/or steam to be reheated is flowed through tubes while the heating medium flows over the tubes so that the heating medium heats the fluid flowing within the tubes. Often different tubes are provided for heating the feedwater (economizer tubes), generating steam from the water (evaporator tubes) and for superheating the steam which is generated in the evaporator tubes, (superheater tubes). The tubes may be helical coil tubes, or straight tubes or bent tubes, or they may be bayonet tube assemblies. Usually the tubes are connected with one or more tube sheets so that the heating medium and the fluid which flows through the tubes are separated.

An example of a steam generator which uses bayonet tubes and all of which are connected with a single tube sheet is found in co-pending U.S. Pat. application Ser. No. 486,286, which was filed on July 8, 1974. There, tubes used for different phases of steam generation such as economizer tubes, evaporator tubes and superheater tubes are connected to the same tube sheet. Chambers generally below that tube sheet, allow fluid leaving the economizer bayonet tube assemblies to flow into the evaporator tube assemblies and to flow from the evaporator tube assemblies to the superheater tube assemblies. While this arrangement is satisfactory from a standpoint of efficiency, thermal balance and energy output there are certain situations in which construction of such a steam generator would be rather expensive. For example, in a large steam generator the chambers below the tube sheet will hold steam at high pressure and consequently the tube sheet and the associated structure necessary to define the chambers will have to be of sufficient dimensions to withstand the high pressures over a large area. A tube sheet is strengthened by making it thicker. This not only adds to the cost and weight of the steam generator, but also makes for a steam generator which will not withstand large temperature gradients over the tube sheet without cracking.

Further, tube sheet failure results in leakage of steam up through the tube sheet to mix with the heating medium and after the pressure above and below tube sheet equalize the heating medium will contaminate the steam. A subsequent failure below the tube sheet would then result in the heating medium being released. This is not acceptable from a safety viewpoint.

SUMMARY OF THE INVENTION

It is an object of the present invention to overcome the drawbacks found in the prior art such as those discussed above. Accordingly, an economizer bayonet tube assembly, evaporator bayonet tube assembly, and a superheater bayonet tube assembly are connected to a tube sheet positioned within a pressure vessel, so that a heating medium can be passed over the bayonet tube assemblies and water can be flowed to the inner tube of the economizer bayonet tube assembly, so that it will be heated as it flows between the inner and outer tubes of the economizer bayonet tube assembly, and thereafter directed into the space between the inner and outer tubes of the evaporator bayonet tube assembly, so that it evaporates the steam which is formed being directed into the space between inner and outer tubes of a superheater bayonet assembly, the communication of water and/or steam between one or more of said bayonet tube assemblies being through connecting tubes which connect thermal sleeves encircling the inner tubes of the connected bayonet tube assemblies below the tube sheet.

BRIEF DESCRIPTION OF THE DRAWINGS

The drawing is a front view, partly in section, showing a heat exchanger made in accordance with the present invention.

DETAILED DESCRIPTION OF THE PREFERRED EMBODIMENT

There is shown in the drawing a steam generator indicated generally as 10 having an outer shell 12 surrounded by concrete 14 and which includes a helium intake 16 and a helium exhaust 18. An annular generally cylindrical outer flow shroud 20 is adjacent to the outer shell 12 and extends from a level adjacent to the top of the outer shell 12 to a location slightly lower than the helium intake 16. A middle flow shroud 22 is concentric with the outer flow shroud 20 and an inner flow shroud 24 is concentric with the outer and middle flow shrouds 20 and 22. The middle flow shroud 22 is of a smaller diameter than the outer flow shroud 20 and the inner flow shroud 24 is of a smaller diameter than the middle flow shroud 22.

An annular plate 26 extends over and connects with the tops of each of the flow shrouds 20, 22, and 24. A number of openings 28, in the upper portion of the middle flow shroud 22 permit helium to flow through the middle shroud immediately below the plate 26. The inner flow shroud 24 extends above the plate 26 and can serve as a support during construction of the present steam generator 10. During construction the top of the inner flow shroud 24 can be supported while work progresses outward during the fabrication of the present steam generator 10.

The outer flow shroud 20 and the middle flow shroud 22 define with the annular plate 26 an annular outer flow chamber 30 and the middle flow shroud 22 and the inner flow shroud 24 define with the annular plate 26, a middle flow chamber 32. The inner flow shroud 24 encircles a center flow chamber 34. Helium entering through the helium intake 16 cannot flow upward between the outer flow shroud 20 and the outer shell 12 because seal rings 36 and 37 are positioned between the outer flow shroud 20 and the outer shell 12 above the helium intake 16. Any helium escaping past the seal rings 36 and 37 will be blocked by the bellows seal 38 which brings the outer shroud 20 and the outer shell 12 at the upper portions thereof above the seal ring 36. A stagnant layer of helium will form between the outer shell 12 and the outer flow shroud 20 above the helium intake 16 and a flow of helium downward between the outer flow shroud 20 and the outer shell 12 will be created.

The helium flowing downward from the helium intake 16 will flow down against a tube sheet 40 which is positioned slightly below the bottom of the outer flow shroud 20. The middle flow shroud 22 extends down to the tube sheet 40 so that the helium flowing under the outer flow shroud 20 will reverse its direction to flow upward through the outer flow chamber 30 between the outer flow shroud 20 and the middle flow shroud 22. There are a number of perforated tube supports 42 across the flow chambers 30, 32 and 34 which support the tubes which will be described infra without preventing fluid flow. The helium will flow upward until it can rise no further because of the annular plate 26. The helium will then flow radially inward under the plate 26 through the flow openings 28 and into the middle flow chamber 32 between the iner flow shroud 24 and the middle flow shroud 22. Helium will then flow downward through the middle flow chamber 32 and since the inner flow shroud 24 does not extend down to the tube sheet 40, the helium will flow under the inner flow shroud 24 and radially inward to the central flow chamber 34 where it will flow upward to the helium exhaust 18 where it will leave the steam generator 10.

The helium flow is, then, generally a three-pass flow, the first pass being upward through the outer flow chamber 30, the second pass being down through the middle flow chamber 32 and finally the third pass being upward through the central flow chamber 34.

The present steam generator provides for the reheating of steam which enters through a steam line 50 in the outer shell 12 below the tube sheet 40. Thus, during operation the portion of the present steam generator below the main tube sheet 40 will be filled with steam which is to be reheated. There is a burst disc 52 placed in the bottom of the shell 12 but the disc is constructed so that it will not burst except under a pressure considerably higher than that of steam which is reheated during the operation of the present steam generator 10. The steam to be reheated will flow upward through bayonet tube assemblies 54 each of which includes an outer tube 56 and an inner tube 58. The outer tubes 56 are each closed at their upper end 60 and, as shown in the drawing, since the outer tubes 56 extend down only to the bottom of the tube sheet 40 and the inner tubes extend down to a header 62 which is annular and which feeds into a reheated steam supply line 64, the steam to be reheated will flow upward in an annular space between the outer tubes 56 and the inner tubes 58. The steam will flow upward until it can go no higher because of the closed end 60 where it reverses direction to flow downward through the inner tubes 58 to the header 62 and to thereafter leave the present steam generator 10 through the reheated steam supply line 64. The steam will be reheated as it passes upwardly to the annuli between the outer tubes 56 and the inner tubes 58 by the hot helium gas which is flowing upward through the outer flow chamber 30. Preferably, the inner tubes 58 are insulated so that no heat will be lost by the steam passing down through them. The lower ends of the outer tubes 56 seal with the tube sheet 40 so that there is no leakage of steam into the area above the tube sheet 40.

The steam generator 10 also provides for the generation and superheating of steam from feedwater. Feedwater enters the steam generator 10 through a feedwater lead 70 which is connected to a feedwater header 72 which is annular in configuration and which supplies feedwater to a plurality of economizer bayonet tube assemblies 80 which extends upward within the central flow chamber 34 from below the tube sheet 40. The economizer bayonet tube assemblies 80 each have an inner tube 82 and an outer tube 84, each of which is closed at its upper end 86. The upper portions of some of the economizer tube assemblies 80 are broken off for clarity in the drawing. Only the inner tubes 82 extend downward to the feedwater header 72, the outer tubes 84 extending downward only to a location 88 where they are sealed with respect to each of their associated inner tubes 82. The outer tubes 84 serve as heat exchange tubes above the tube sheet 40 and as thermal sleeves, i.e., as insulators between the tube sheet 40.

Feedwater which has flowed through the feedwater lead 70 to the feedwater header 72 will flow upward through the inner tubes 82 to impinge against the closed ends 86 and then flow downward through the annuli between the inner tubes 82 and the outer tubes 84. During this downward pass, the feedwater is heated by the helium flowing through the central flow chamber 34.

Since the inner and outer tubes are joined at 88, the heated feedwater cannot pass down below that location. The heated feedwater will pass out of the economizer bayonet tube assemblies 80 through a plurality of tees, each of which connects with a connecting tube 92 which connects an economizer bayonet tube assembly 80 with an evaporator bayonet tube assembly 96.

Each of the evaporator bayonet tube assemblies 96 has an outer tube 98 and an inner tube 100. The inner tubes 100 and the outer tubes 98 are joined together at a location 102 below the tube sheet 40. Each of the connecting tubes 92 connect with a tee in one of the outer tubes 98 so that the heated feedwater coming out of the economizer bayonet tube assemblies 80 will pass through the connecting tubes 92 to the evaporator bayonet tube assemblies 96. The heated feedwater will pass upward in the annuli between the outer tubes 98 and the inner tubes 100. As the water passes upward, it will be heated by helium passing downward to the middle flow chamber 32 and changed into steam. The steam will pass upward only until it impinges against the closed ends of the outer tubes 98 to reverse its direction and flow down through the inner tubes 100. The steam flows down as far as it can go in the tubes 100, that is, below the locations 102 where the inner tubes 100 are joined to the outer tubes 98. The outer tubes 98 serve as heat exchange tubes above the tube sheet 40 and as thermal sleeves below it.

Each of the inner tubes 100 is connected, below its associated outer tube 98, with a connecting tube 104 which connects at least one of the inner tubes 100 with a superheater bayonet tube assembly 110. The superheater bayonet tube assemblies 110 each have an outer tube 112 closed at its upper end 114 and an inner tube 116. The outer tubes 112 are connected with the tube sheet 40 in a manner similar to the outer tubes of the bayonet tube assemblies 80 and 96. The outer tubes 112 serve as heat exchange tubes above the tube sheet 40 and as thermal sleeves below it., and inner tubes 116 are joined together at the lower ends 118 of the outer tubes 112. The connecting tubes 104 connect with the outer tubes 112 so that steam coming through the connecting tubes 104 from the evaporator tube assemblies 96 will travel upwardly in the annuli between the inner tubes 116 and the outer tubes 112 to be superheated by hot helium flowing upward in the outer flow chamber 30. The steam will flow upward only to the closed ends 114 to reverse its direction and flow down through the inner tubes 116. The inner tubes 116 connect with an annular superheated steam header 120 which connects with a superheated steam supply line 122 which supplies superheated steam to an appropriate apparatus such as the high pressure turbine of a steam power plant.

Typically, the feedwater coming out of the economizer section will be between 600° F. and 700° F. In the present invention it passes through the tube sheet 40 while contacting the outer tubes of the economizer section. The water, which is brought close to the boiling point, then passes through the evaporator bayonet tubes in the annuli between the inner and outer tubes at only a slightly higher temperature than the feedwater. In these tubes water is generated into steam which is only slightly superheated. The steam then passes to the superheater section to pass between the inner and outer tubes as the superheater bayonet tube assembly. Here, the temperature of the steam is raised considerably, but it passes through the tube sheet through the inner tubes of the superheater bayonet tube assemblies so that substantially no heat is transferred from the superheated steam to the tube sheet. Thus, with the present design, the fluids which transfer heat with the main tube sheet are always within a relatively small temperature range. Therefore, there will be no substantial temperature gradients across the tube sheet. The absence of temperature gradients will prevent the structural failures concomitant with large temperature gradients in the presence of tube sheets.

As already pointed out, the present heat exchanger also includes a reheater section in which the steam to be reheated passes through bayonet tubes connected with the tube sheet at a temperature fairly close to the feedwater, the water heated in the economizer section, and the unsuperheated steam which exchange heat with the tube sheet. Thus, even with the reheater section there will be no excessive temperature gradient at the tube sheet due to large differences in temperature between the fluids which flow through the tube sheet.

The reheater and superheater sections are both located within the same helium flow chamber 30 so that available heat can be allocated between these two sections. To that end, a series of dampers 224 is provided between the upper ends of the bayonet tube assemblies which make up the reheater and superheater sections. By adjusting the dampers 224 the flow of hot helium can be divided between the two sections selectively for optimum efficiency.

In the present invention, feedwater, heated water, unsuperheated and superheated steam, as well as steam which has been reheated to a degree of superheat, are always flowing within tubes below the tube sheet 40. Only low pressure steam to be reheated is allowed to flow in the large chamber below the tube sheet 40. With this arrangement, there are no chambers below the tube sheet 40 containing fluid under pressure which is considerably higher than a typical operating pressure of helium which is flowing above the tube sheet 40. Thus, the tube sheet 40 does not have to withstand any large pressure gradient so that it is possible to make the tube sheet 40 thinner than would otherwise be possible.

From a safety viewpoint, failure of tube sheet results in the heating medium entering the space below the tube sheet which has been designed to withstand the pressure which would result from such a failure.

The foregoing describes but one preferred embodiment of the present invention, other embodiments being possible without exceeding the scope thereof as defined in the following claims.

What is claimed is:

1. A helium heated steam generator comprising:
an outer shell;
a helium intake in said outer shell;
a helium exhaust in said outer shell;
a tube sheet in said outer shell;
an economizer bayonet tube assembly extending upward from said tube sheet;
an evaporator bayonet tube assembly extending upward from said tube sheet;
a superheater bayonet tube assembly extending upward from said tube sheet;
each of said bayonet tube assemblies having an inner tube and a coaxial outer tube of larger diameter, said outer tubes having a closed upper end with said inner tubes extending below the bottoms of said outer tubes, said outer tubes and said inner tubes being joined together at the bottoms of said outer tubes;
a connecting pipe for connecting the space between the inner and outer tubes of said economizer bayonet tube assembly with the space between said inner and outer tubes of said evaporator bayonet tube assembly;
another connecting pipe for connecting the space within the inner tube of said evaporator bayonet tube assembly with the space between the inner and outer tubes of said superheater bayonet tube assembly;
a feedwater lead for supplying feedwater to said economizer bayonet tube assembly; and
a steam outlet in said shell connected with the inner tube of said superheater bayonet tube assembly.

2. The steam generator defined in claim 1 further comprising:
a reheater bayonet tube assembly having an inner tube, and a coaxial outer tube connected to the main tube sheet, said outer tube being closed at its upper end and open at its lower end, said inner tube extending below said outer tube and connected with a reheated steam supply line, and a steam inlet in said outer shell below said tube sheet so that when steam to be reheated flows through said steam inlet it will flow into the space below said tube sheet to then flow up in the annulus between the inner and outer tubes of said reheater bayonet tube assembly to reverse its direction at the closed end of said outer tube to flow down through the inner tube of said reheater bayonet tube assembly to leave said steam generator through said reheated steam supply line.

3. The steam generator defined in claim 2 further comprising:
a flow shroud, said flow shroud extending between said superheater and said reheater bayonet tube assemblies, a damper positioned between said reheater and superheater bayonet assemblies for regulating the flow of helium gas over each of said reheater and superheater assemblies.

4. The steam generator defined in claim 1 wherein said economizer bayonet tube assembly, said evaporator bayonet tube assembly and said superheater bayonet tube assembly are each one of a number of such assemblies and wherein said connecting pipe is one of a number of connecting pipes connecting the spaces between the inner and outer tubes of said economizer bayonet tube assemblies with the spaces between said inner and outer tubes of said evaporator bayonet tube assemblies, said other connecting pipe is one of a number of connecting pipes connecting the spaces within the inner tubes of said evaporator bayonet tube assemblies with the spaces between the inner and outer tubes of said superheater bayonet tube assemblies.

5. The steam generator defined in claim 2 wherein said reheater bayonet tube assembly is one of a number of reheater bayonet tube assemblies.

* * * * *